US011993940B1

(12) United States Patent
Jordan, IV

(10) Patent No.: US 11,993,940 B1
(45) Date of Patent: May 28, 2024

(54) DECK REJUVENATION SYSTEM AND METHOD

(71) Applicants: Robert B. Jordan, IV, Mount Gilead, NC (US); Eddie Alexander Meeks, Greensboro, NC (US)

(72) Inventor: Robert B. Jordan, IV, Mt. Gilead, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 0 days.

(21) Appl. No.: 17/363,173

(22) Filed: Jun. 30, 2021

Related U.S. Application Data

(63) Continuation of application No. 16/721,280, filed on Dec. 19, 2019, now Pat. No. 11,053,694.

(51) Int. Cl.
*E04F 15/02* (2006.01)
*E04B 1/00* (2006.01)
*E04F 15/04* (2006.01)

(52) U.S. Cl.
CPC ..... *E04F 15/04* (2013.01); *E04B 1/003* (2013.01); *E04F 15/02038* (2013.01); *E04F 15/0215* (2013.01); *E04F 15/02161* (2013.01); *E04F 15/02183* (2013.01)

(58) Field of Classification Search
CPC ..... E04F 15/02183; E04F 15/10; E04F 15/02161; E04F 15/04; E04F 15/0215; E04F 15/02155; E04B 1/003
See application file for complete search history.

(56) References Cited

U.S. PATENT DOCUMENTS

| | | | | |
|---|---|---|---|---|
| 1,077,223 A * | 10/1913 | Dixon | E04F 15/10 52/177 |
| 2,044,407 A | 6/1936 | Smith | 154/49 |
| D176,720 S | 1/1956 | Hudd | D15/8 |
| D186,165 S | 9/1959 | Griswold | D18/2 |
| 3,085,651 A | 4/1963 | Rich | 182/222 |

(Continued)

FOREIGN PATENT DOCUMENTS

| | | |
|---|---|---|
| EM | 001845645-0006 | 4/2011 |
| KR | 300732114.0000 | 3/2014 |

OTHER PUBLICATIONS

DLH Decking Tiles FSC 1996 iclip and iconnect fastening system.

(Continued)

*Primary Examiner* — Kyle J. Walraed-Sullivan
(74) *Attorney, Agent, or Firm* — MacCord Mason PLLC

(57) ABSTRACT

A deck resurfacing material is made of a kiln-dried, southern yellow pine wood board. The board has had treatment with a non-metallic preservative and stabilizer system. The board has a top, a length, two ends and two sides with side edges. A grooved pattern on top includes flat areas at each side, two sets of grooves interiorly of the flat areas and another flat area interiorly between the two sets of grooves. The board has a transition from the top to each side edge that is radiused and the side edges are not tongue-and grooved. The two ends have end matching in the form of a tongue at one end of the board and a groove at the other end of the board so the board can be installed with end matching to a like board, and a transition from the top to each end that is a radiused.

10 Claims, 6 Drawing Sheets

(56) References Cited

U.S. PATENT DOCUMENTS 3,959,830 A 6/1976 Van den Broek ..... 4/172.19
4,451,063 A 5/1984 Snyder ..... 280/163
D279,607 S 7/1985 Rutter ..... D25/69
4,885,882 A * 12/1989 Forshee ..... B63B 3/48 52/177
5,226,273 A * 7/1993 Burke ..... E01C 5/223 52/390
5,339,581 A * 8/1994 Schlickenmeyer ..... E04F 15/04 52/480
D363,785 S 10/1995 Davies ..... D25/69
5,623,803 A * 4/1997 Willis ..... E04H 17/168 52/480
5,694,730 A 12/1997 Del Rincon et al. ..... 52/586.1
5,735,097 A 4/1998 Cheyne
5,913,784 A * 6/1999 Hite ..... E04F 15/10 52/177
D415,575 S 10/1999 Nickel ..... D25/62
D418,926 S 1/2000 Owens et al. ..... D25/138
6,189,279 B1 * 2/2001 Fiechtl ..... B32B 27/065 52/480
6,453,630 B1 * 9/2002 Buhrts ..... E04F 15/02183 52/177
6,584,748 B2 7/2003 Bresnahan
D509,003 S 8/2005 Stubbersfield ..... D25/121
D564,240 S 3/2008 Poo ..... D5/99
D574,975 S 8/2008 Neuhofer, Jr. ..... D25/164
7,503,146 B2 * 3/2009 Thomas ..... E04F 15/02183 52/177
7,793,469 B2 9/2010 Murphy, Jr. et al. ..... 52/177
D683,479 S 5/2013 Göransson et al. ..... D25/69
D714,964 S 10/2014 Hoskinson et al. ..... D25/69
D718,875 S 12/2014 Ramos Moreno et al. ... D25/69
9,416,552 B2 8/2016 Karlsen et al.
D787,583 S 5/2017 Canivell Grifols et al. .. D17/20
10,011,998 B1 * 7/2018 Dantzer ..... E04F 15/02044
2005/0025925 A1 * 2/2005 O'Connor ..... E04F 15/163 428/40.1
2005/0178071 A1 * 8/2005 Wood ..... E04F 15/02 52/836
2006/0101773 A1 * 5/2006 Turner ..... E04F 15/183 52/650.3
2006/0230693 A1 10/2006 Giordano ..... 52/182
2008/0201874 A1 8/2008 Coyle et al. ..... 14/71.1
2010/0132276 A1 * 6/2010 Landry ..... E04F 15/00 52/177
2012/0073225 A1 3/2012 Douglass
2012/0073325 A1 * 3/2012 Giordano ..... A44C 11/007 63/4
2013/0255175 A1 * 10/2013 Borowick ..... E04F 15/02183 52/745.21
2014/0363621 A1 * 12/2014 Ngo ..... E04F 15/02194 52/309.1
2016/0024803 A1 * 1/2016 Chitouras ..... B32B 21/08 52/746.1
2016/0215506 A1 * 7/2016 Sisler ..... E04F 15/02172
2018/0223529 A1 * 8/2018 Tebb ..... E04F 15/043

OTHER PUBLICATIONS

Lame De Terrasse Bois Exotique (on-line), dated Jun. 14, 2013.
Lame De Terrasse En Pin—Blooma (on-line).
Anti Slip Decking, Post and Poles (on-line).
Slip Resistant Decking Boards (on-line).

* cited by examiner

DECK REJUVENATION SYSTEM AND METHOD

BACKGROUND OF THE INVENTION

Wooden decks that have aged or that need a new look have historically been expensive and time consuming to restore. The existing wooden decking material has typically been mounted on joists such as 2×6 joists and the wooden decking material must be ripped up and replaced on the joists to renew the top surface of the deck. This is a labor intensive effort, including the need to dispose of the existing wooden decking material.

Wooden decks are often subject to checking. Wood shrinks as it dries, but if it dries unevenly, the faster-shrinking areas pull apart from the slower-drying ones, creating cracks and splits called "checking." Exposure to the elements can accelerate the checking process, so that decks are often subject to checking issues within about three years after initial installation.

SUMMARY OF THE INVENTION

The present invention fulfills one or more of these needs in the art by providing a kit of materials to use to rejuvenate or resurface a deck including a plurality of boards with a combined surface area to cover at least 10 square feet, sufficient glue to bond the 10 square feet of boards to an existing deck surface, and brads to help hold the boards down on the existing deck surface during curing of the glue.

Preferably, the boards of the kit of materials have a grooved pattern on a top. The grooved pattern for a board that has a length and two sides includes flat areas at each side, two sets of grooves interiorly of the flat areas and another flat area interiorly between the two sets of grooves.

Preferably, each board has a length and two sides and side edges and the side edges are not tongue-and grooved. Each board may have a transition from the top to each side edge that is radiused.

Each board preferably has end matching in the form of a tongue at one end of each board and a groove at the other end of each board so the boards can be installed with end matching. Preferably, each board has a transition from the top to each end that is radiused.

Preferably, each board has been continuous kiln dried, patterned, reverse grooved, and end matched. A preferred board species is Southern yellow pine. Preferably the boards have had "EcoLife" treatment with a non-metallic preservative and stabilizer system.

The invention can also be considered as a method of rejuvenating an existing deck surface including removing dirt and debris from the existing deck surface. Then boards are installed on top of the existing deck surface by applying glue to undersides of new boards and gluing them onto the existing deck surface. Each new board that is applied interior of an edge of the existing deck surface is end matched with boards adjacent its end and not being joined with tongue and groove to boards adjacent its sides. The glued boards are held in place with brads while the glue sets.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

The "Deck Rejuvenation System" addresses the problem of rejuvenating a wood deck, as well as freshening decks made of other materials. The first step is to measure the existing deck O (See FIG. 1) to be rejuvenated. If it has any rotten boards, they need to be replaced. Otherwise, it is not necessary to remove the existing decking boards from the sub-structure, which is the deck construction that is located below, and supports the deck boards and railing system. Sub-structure components may include joists and hangers, ledgers, rim joists, beams, posts, anchors and footers.

The kit materials can be made available in either Patio 1 or Patio 2 grade. For a 10'×10' deck area to be rejuvenated, ten kits that each covers 10 square feet are needed to cover the 100 square feet of the deck. The boards of the new deck surface can be applied unstained or stained. Kits can be made to cover different square footage areas.

Figure 7:
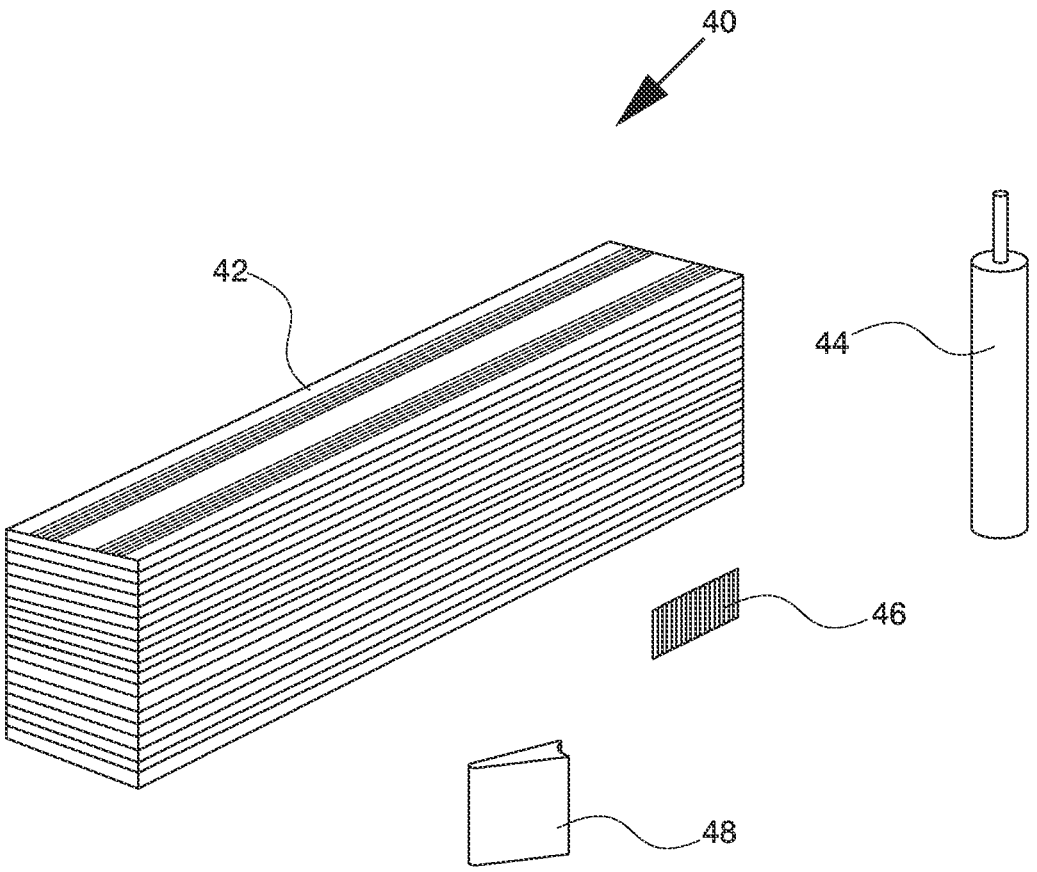
FIG. 7 is a perspective view of a kit of materials in accordance with an embodiment.
Figure 8:
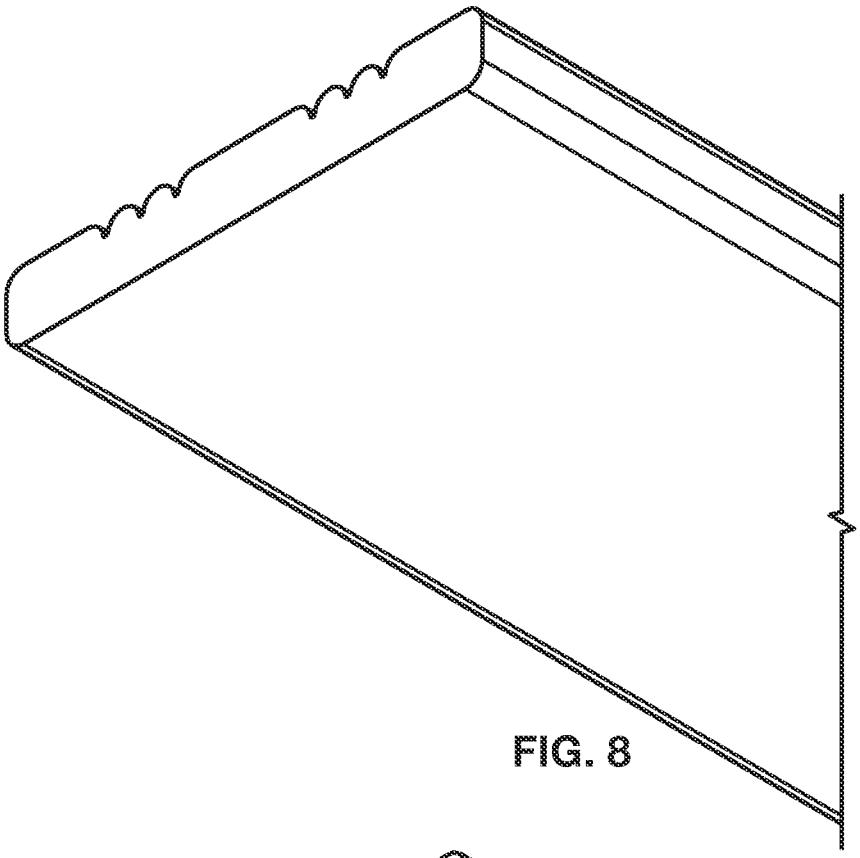
FIG. 8 is an end view of another board embodiment.
Figure 9:
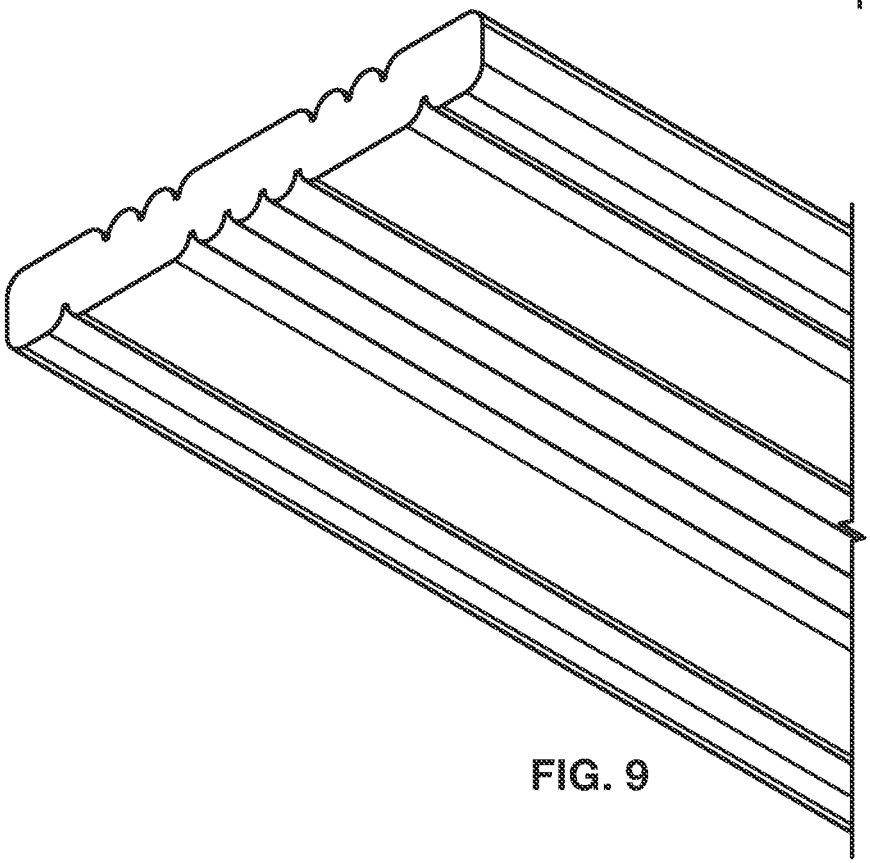
FIG. 9 is an end view of another board embodiment.
Figure 10:
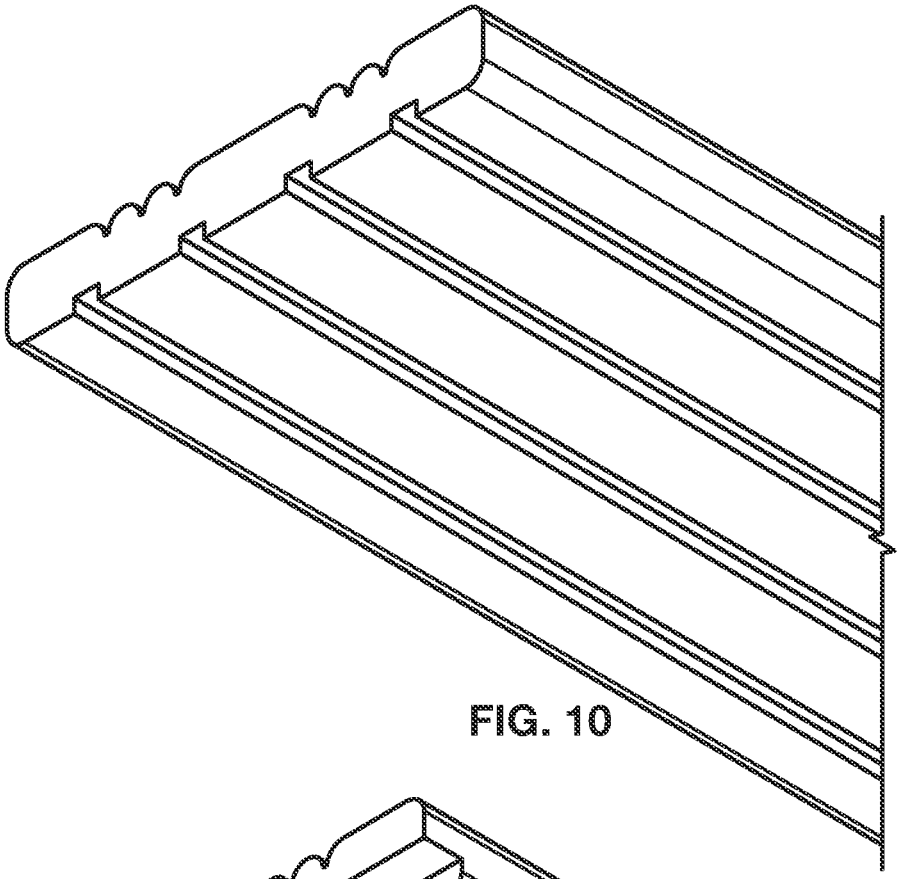
FIG. 10 is an end view of another board embodiment.
Figure 11:
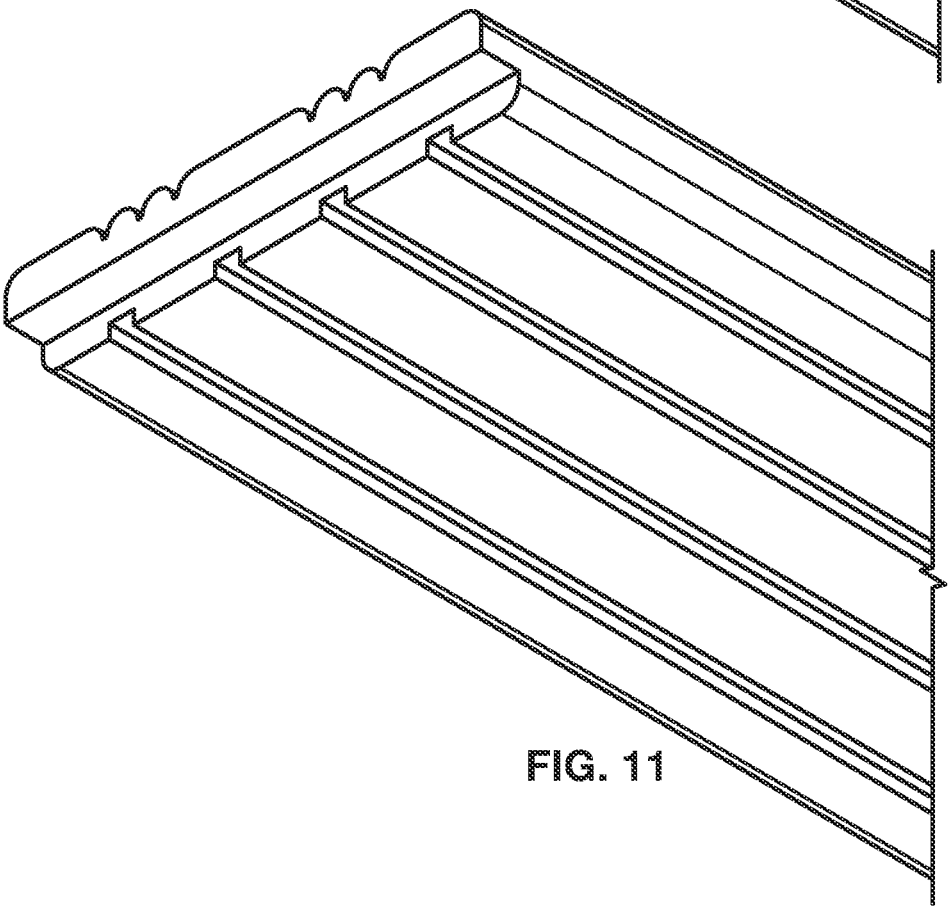
FIG. 11 is an end view of another board embodiment.

The boards of the new deck are solid wood and preferably continuous kiln dried, patterned, reverse-grooved, and end matched. Preferably they have been EcoLife™ treated and dried after treatment. The preferred boards are one half inch thick and 5½ inches wide. Board lengths of two feet are preferred, but other lengths can be substituted. As seen in FIG. 7, with the dimensions just noted, ten boards or pieces 42 will come packaged as a kit 40 to cover 10 square feet of deck. The kit 40 will also include sufficient glue 44 and a set 46 of small 18 gauge brads to help hold the pieces down during the short curing time of the glue. Installation instructions 48 may also be included in the kit. The preferred glue is "Liquid Nails Heavy Duty," available from Akzo Nobel Paints LLC, 15885 West Sprague Rd., Strongsville, OH 44136 www.liquidnails.com. Other waterproof glues may be used.

Liquid Nails Heavy Duty is a mixture with the product name LN-903 Heavy Duty AHE90312TN0. According to MSDS for Liquid Nails Heavy Duty, it is made of:

| Ingredient Name | % |
|---|---|
| Limestone | ≥25-<50 |
| Kaolin | ≥5-<10 |
| Propane-1,2-diol | ≥1-<3 |
| Crystalline silica, respirable powder (<10 microns) | ≥0.3-<1 |

Figure 5:
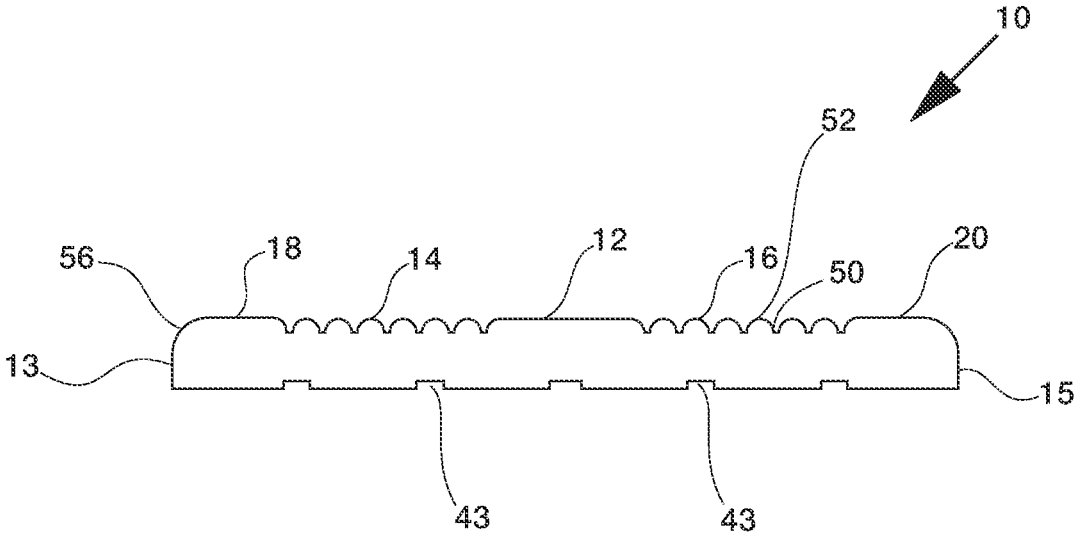
FIG. 5 is an end view of a board in accordance with a preferred embodiment, showing the features of the top, bottom and sides of the board.

As seen in FIG. 5, boards 10 have a grooved pattern on the top that greatly resists checking and helps resist bow and twist. It is believed that the wood in the boards of the preferred embodiment will resist checking for at least eight years, much longer than the conventional three years. The pattern includes a central flat area 12, first and second sets 14 and 16 of grooves and outer flat areas 18 and 20. As can be seen in FIG. 5, a preferred embodiment has seven grooves 50 in each set, but other numbers of grooves can be used, as seen in FIGS. 8-11. Also as seen in FIG. 5, each groove 50 is adjacent a rounded land 52. Flat areas 12, 14, and 18 at the edges and middle of each board are comfortable underfoot. FIG. 5 also shows the sides 13 and 15 of the board as straight and free of tongue and groove features. The transitions from the top of the board to the sides 13 and 15 are radiused, as shown at 56. The radius edge aids draining and prevents splintering. FIG. 5 also shows the grooves 43 on the underside of the board that extend longitudinally along the length of the board and can be used to hold the glue at installation-time. The grooves 43 also help prevent the wood from cupping. The preferred wood for the boards is Southern Yellow Pine. The wood is preferably dried, kiln dried, and then dried again.

When added to the top of an old, existing deck that built with commonly used 5/4×6 decking material, the boards 10 give the deck a new, stronger thickness equivalent to having built the deck out of 2" by 6" boards. The ½ "thickness allows the boards of the rejuvenation kit to be used on top of almost any deck without causing issues at door thresholds.

As noted, preferably, the boards have had EcoLife" treatment, which provides an environmentally friendly protection that is expected to prevent rot for over 30 years. EcoLife treatment is available from Viance LLC of Charlotte, North Carolina and is a non-metallic preservative and stabilizer system, offering the natural beauty of real wood combined with advances in weathering protection and fastener performance.

Figure 6:
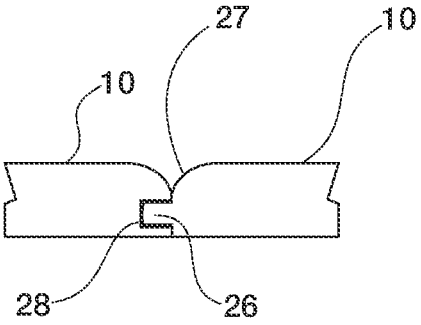
FIG. 6 is a side view of the ends of two boards in end match engagement with one another.

The end-match system on the products as seen in FIG. 6 adds stability to the existing deck and provides the "solid-under-foot" feel of a high quality deck. End match is the result of each board having a tongue 26 at one end and a groove 28 at its other end. At installation, the tongue of one board is inserted into the groove an end-wise adjacent board. The radius edge 27 added above those elements of the end match system gives the joints better drainage and adds a high end look.

As seen in FIG. 7, the product can be marketed in a kit form 40, with ten boards 42 to cover 10 square feet, sufficient glue 44 to bond the 10 square feet of boards to an existing deck surface, brads 46 to help hold the pieces down during curing, and installation instructions 48.

Any exterior deck (or concrete patio) in need of a new great look can be rejuvenated to look brand new and vibrant. This can be easily accomplished with very little time, expense and effort. The expense and time saved over replacing the deck is substantial.

Figure 1:
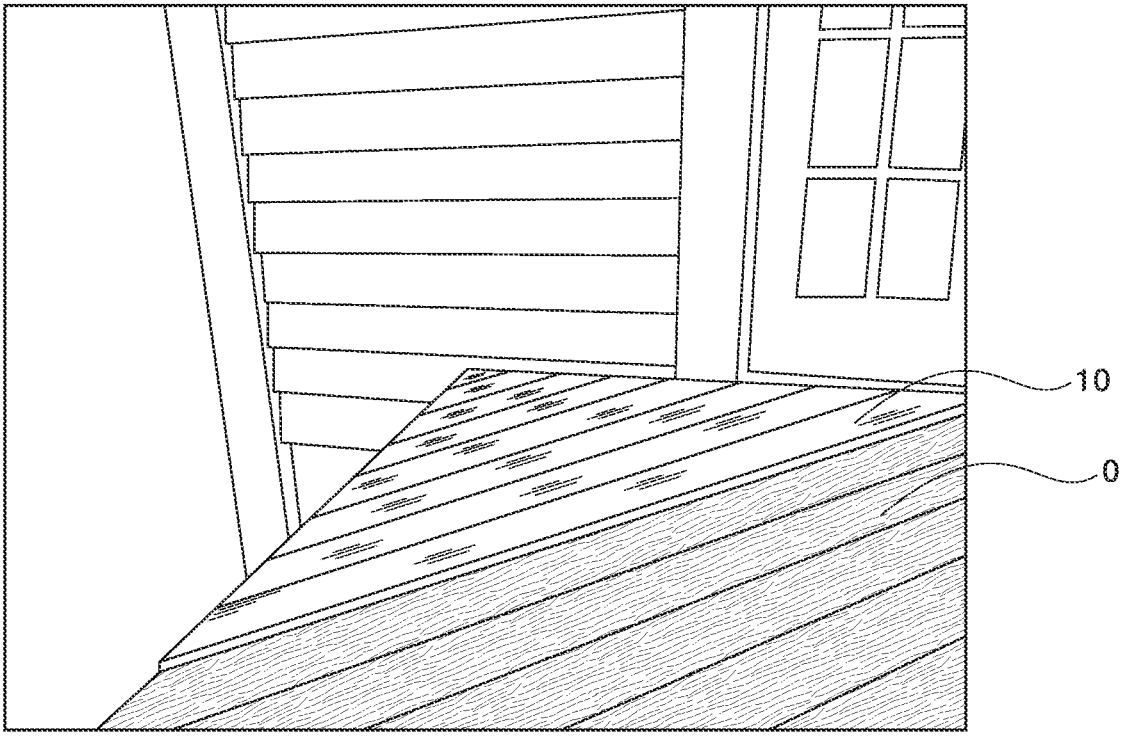
FIG. 1 is a perspective view of an existing deck having received several boards in accordance with an embodiment of the invention.
Figure 2:
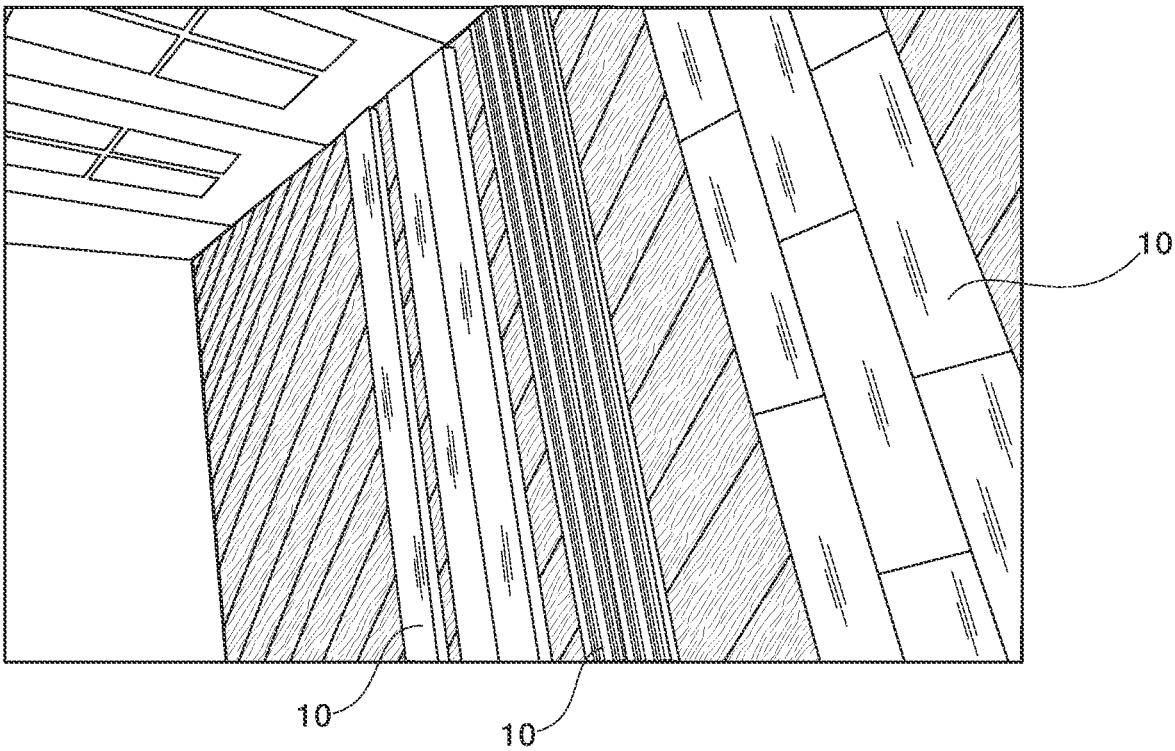
FIG. 2 is a perspective view of another existing deck having received several boards in accordance with an embodiment.
Figure 3:
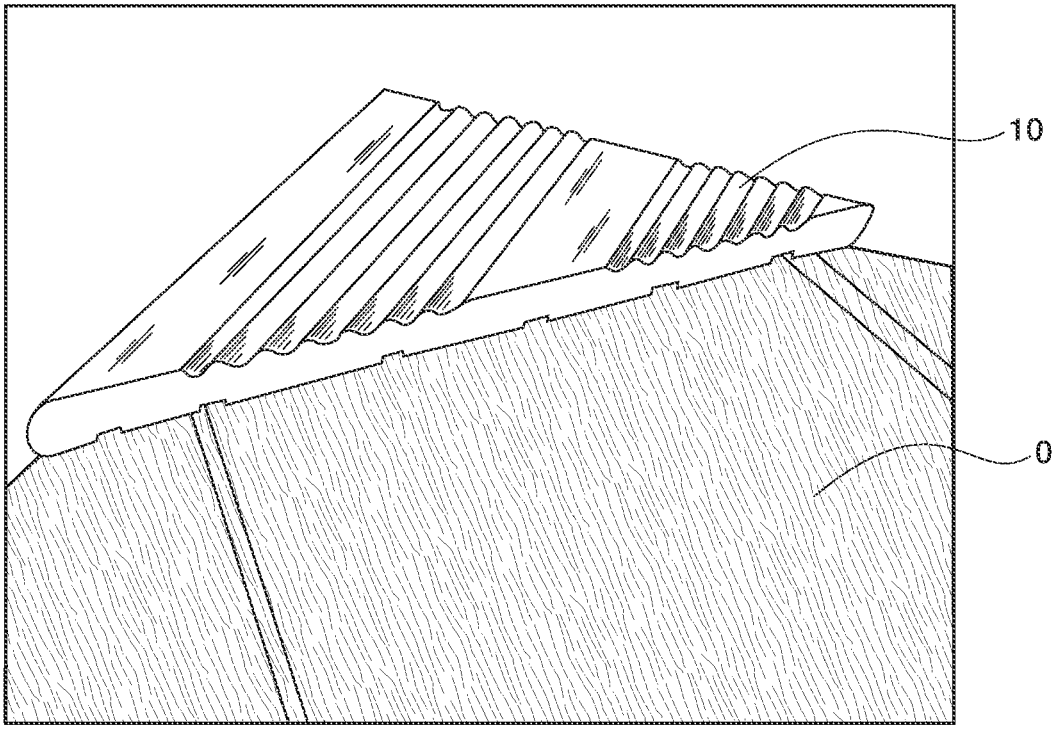
FIG. 3 is a perspective view of a corner of an existing deck having received one sawn board in accordance with an embodiment.
Figure 4:
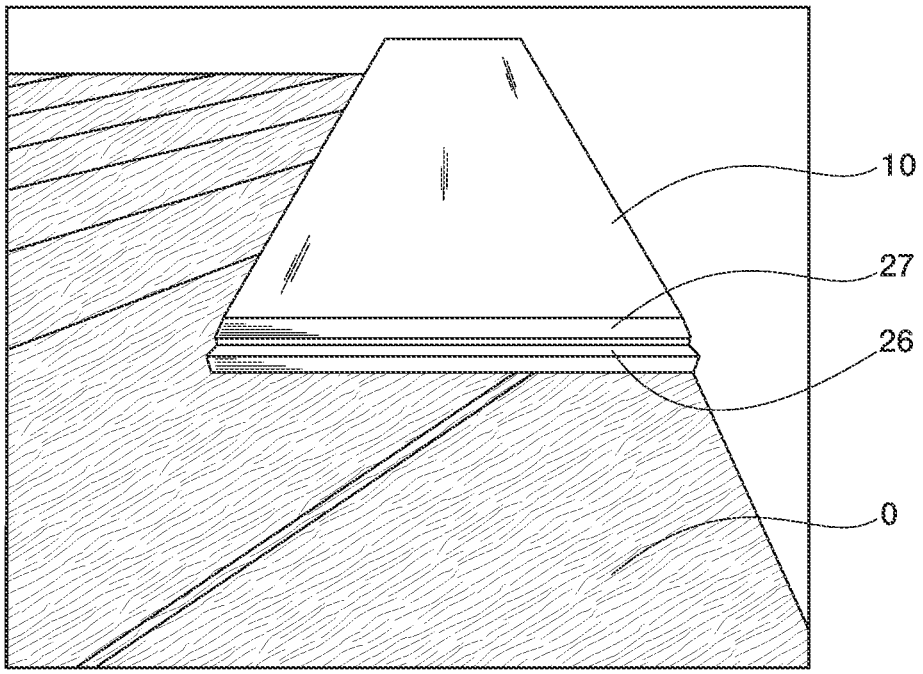
FIG. 4 is a perspective view of an existing deck having received one board in accordance with an embodiment of the invention, and showing an end match tongue element on the board.

The boards of the "Deck rejuvenation System" can be laid out on a deck any way desired, as seen in FIGS. 1-4. The boards can run in the direction of existing decking pieces as shown in FIG. 1, perpendicular to the original boards of the deck, or at angles in any direction. The boards can be laid in a combination of patterns. The tools needed to install the materials of the kit are a saw, a small hammer or brad gun, safety goggles, and gloves.

To install the new deck surface, first make sure the existing deck is clean and free from dirt and debris and that all rotten boards in the existing deck have been replaced. If a stain color is to be added, it is suggested that the boards be stained at least a day before installation over the existing deck surface and dry in a cool, clean area.

Next the boards 10 are cut to size. The cutting needed may include cuts at other than right angles to accommodate edge configurations, as seen in FIG. 1, where the installation is at a diagonal, so the board ends are cut at 45 degree angles. Other angles may be preferred for other installations. Then the installer applies glue 44 (which is preferably provided in the kit 40) onto the back sides of the boards. Each board has underside grooves 43 which can be loaded with glue, and the glue is preferably applied in a pattern over the bottom of the board 10. The board is then placed on the existing deck surface, with tongues on board ends inserted into grooves on the ends of boards that have been added previously (or the reverse process: a board so its groove receives the tongue of a previously-installed board end). Once the board is in a desired position, the process includes applying the brads 46 by hammering through the board into the existing deck surface to help hold the pieces firmly in place while the glue cures. The installer can drive the small brads all the way in, planning to leave them, or drive them in only partially and leave the top of the brad exposed for easy removal after the glue cures. Once the glue has cured, the brads can be removed if desired. Otherwise, the rejuvenated, beautiful deck is ready for use.

FIGS. 8-11 show the profiles of the ends of other embodiments.

Certain modifications and improvements will occur to those skilled in the art upon reading the foregoing description. It should be understood that all such modifications and improvements have been omitted for the sake of conciseness and readability, but are properly within the scope of the following claims

What is claimed is:

1. A method of rejuvenating an existing deck surface consisting essentially of installing a plurality of new kiln-dried, patterned, grooved southern yellow pine wood boards on top of the existing deck surface by applying glue to undersides of a new wood board of the plurality of new kiln-dried, patterned, grooved southern yellow pine woodboards thereby creating a plurality of glued new wood boards and aligning the glued new wood boards onto the existing deck surface, including installing each glued new wood board that is applied interior of an edge of the existing deck surface with end matching with new wood boards adjacent an end of the new wood board to new wood boards adjacent sides of the new wood board, the sides of the glued new wood boards being free of grooves, and holding the glued new wood boards in place with brads while the glue sets, and wherein the new southern yellow pine wood boards have had been treated with a non-metallic preservative and stabilizer system, have a length and two sides and a top that has a grooved pattern that includes flat areas at each side, two sets of grooves interiorly of the flat areas and another flat area interiorly between the two sets of grooves, have end matching and sides that are free of grooves, and have a radiused transition from the top to each side edge.

2. The method as claimed in claim 1 wherein installing new wood boards on top of the existing deck surface includes applying the new wood boards on top of existing wood boards that served as the existing deck surface.

3. The method as claimed in claim 1 wherein installing new wood boards on top of the existing deck surface includes applying the new wood boards on top of concrete that served as the existing deck surface.

4. The method as claimed in claim 1 wherein installing new wood boards on top of the existing deck surface includes installing new wood boards with a combined surface area to cover at least 10 square feet.

5. The method as claimed in claim 1 wherein installing new wood boards on top of the existing deck surface includes installing new wood boards that have a grooved pattern on a top.

6. The method as claimed in claim 1 wherein installing new wood boards on top of the existing deck surface includes installing new wood boards that have a length and two ends with end matching in the form of a tongue at one end of each new wood board and a groove at the other end of new each wood board so the new wood boards can be installed with end matching.

7. The method as claimed in claim 1 wherein installing new wood boards on top of the existing deck surface includes installing new wood boards that have been kiln dried, patterned, grooved, and end matched.

8. The method as claimed in claim 1 wherein installing new wood boards on top of the existing deck surface includes installing new wood boards that have a grooved pattern on a top, the grooved pattern including at least two sets of seven grooves.

9. The method as claimed in claim 1 wherein installing new wood boards on top of the existing deck surface includes installing new wood boards that have grooved pattern including at least two sets of three grooves.

10. A method of rejuvenating an existing wood board deck consisting essentially of installing new Southern yellow pine wood boards on top of the wood board existing deck surface by applying glue to undersides of the new Southern yellow pine wood boards and gluing the Southern yellow pine wood boards onto the existing wood board deck surface, in which the new Southern yellow pine wood boards a. have had been kiln dried and treated with a non-metallic preservative and stabilizer system, b. have a length and two sides and a top that has a grooved pattern that includes flat areas at each side, two sets of grooves interiorly of the flat areas and another flat area interiorly between the two sets of grooves, c. have end matching and sides that are free of grooves, and d. have a radiused transition from the top to each side edge, including installing each new Southern yellow pine wood board that is applied interior of an edge of the existing deck surface with end matching with new Southern yellow pine wood boards adjacent an end of the new Southern yellow pine wood board to new Southern yellow pine wood boards adjacent sides of the new Southern yellow pine wood board, and holding the glued new Southern yellow pine wood boards in place with brads while the glue sets.

* * * * *